US006092462A

United States Patent [19]

Watanabe

[11] Patent Number: 6,092,462

[45] Date of Patent: Jul. 25, 2000

[54] STENCIL PRINTING METHOD, APPARATUS, AND PLATE INCLUDING SHRINKABLE POLYMERIC MATERIAL

[75] Inventor: Hideo Watanabe, Inashiki-gun, Japan

[73] Assignee: Riso Kagaku Corporation, Tokyo, Japan

[21] Appl. No.: 09/415,464

[22] Filed: Oct. 14, 1999

[30] Foreign Application Priority Data

Oct. 14, 1998 [JP] Japan ..... 10-292514

[51] Int. Cl.[7] ..... B41C 1/14; B41M 1/12; B41L 13/04

[52] U.S. Cl. ..... 101/128.4; 101/129; 101/127; 101/116; 427/143; 427/282; 428/131

[58] Field of Search ..... 101/27, 128.21, 101/128.4, 129, 487, 114, 116; 428/131, 134, 136, 913; 427/143, 282, 288

[56] References Cited

U.S. PATENT DOCUMENTS 5,924,361 7/1999 Watanabe ..... 101/128.4
6,035,778 3/2000 Uchiyama ..... 101/128.4

FOREIGN PATENT DOCUMENTS 0 406 884 A2 1/1991 European Pat. Off. .
59-207285 11/1984 Japan ..... 101/128.4

*Primary Examiner*—John S. Hilten
*Assistant Examiner*—Leslie J. Grohusky
*Attorney, Agent, or Firm*—Pillsbury Madison & Sutro LLP

[57] ABSTRACT

A regenerable stencil printing plate is provided, which can be repeatedly used in master making and printing. The stencil printing plate comprises a film made of such a polymeric material as polypyrrole and polythiophene which shrinks when it adsorbs a specific compound, and numerous fine apertures are formed in the film in cross sectional direction thereof. Stencil printing is performed by providing the stencil printing plate as mentioned above, transferring the compound to the film in such a manner that a desired image is reproduced to expand the apertures selectively at sites to which the compound is transferred, and allowing an image forming material to pass through the thus expanded apertures and transfer to a recording medium. The stencil printing plate can constitute an outer circumferentical surface of an ink-permeable cylindrical printing drum used in a conventional stencil printing apparatus. The plate can be regenerated by desorbing the above compound or coating another compound capable of adsorbing to the plate and expanding the polymeric material to narrow the expanded apertures of the plate.

7 Claims, 1 Drawing Sheet

STENCIL PRINTING METHOD, APPARATUS, AND PLATE INCLUDING SHRINKABLE POLYMERIC MATERIAL

TECHNICAL FIELD

The present invention relates to a stencil printing method and to an apparatus for the same, and more specifically relates to a stencil printing method using a novel type of plate having numerous fine apertures that expand or narrow in response to adsorption or desorption of a specific compound, and to an apparatus for the same.

BACKGROUND OF THE INVENTION

Commonly prevailing as a digital duplicator high in printing speed and low in running cost is a printing machine in which a master is produced by melt-perforating a thermoplastic resin film layer of a heat sensitive stencil sheet by use of a heating means such as a thermal printing head which generates heat in a dot-like pattern in accordance with character or image information converted into electric signals, and in which the stencil sheet is wound around a circumferential surface of a printing drum so that an ink is transferred from the printing drum to a printing sheet through the perforated stencil sheet.

The digital duplicator known in the art requires a device for storing and conveying the heat-sensitive stencil sheet as well as a used-stencil discharging device. When printing is performed based on a new original, a used-sheet must be discarded. Usually, the used-stencil is temporarily stored in a used-stencil discharge box, and then is disposed when the box is full of used-stencils. This is because, in the conventional stencil printing, stencil sheets used as printing plates cannot be regenerated or reused.

BRIEF SUMMARY OF THE INVENTION

An object of the present invention is to provide a stencil printing plate that can be regenerated, and thereby provide a method and an apparatus for stencil printing, which solve the aforementioned problems of the conventional technology and eliminate provision and disposal of heat-sensitive stencil sheets.

In accordance with the present invention, the object above is accomplished by a stencil printing method comprising providing a film made of a polymeric material that shrinks when it adsorbs a specific compound, said film having numerous fine apertures in cross sectional direction thereof, transferring said compound to said film in such a manner that a desired image is reproduced to expand said apertures selectively at sites to which the compound is transferred, and allowing an image forming material to pass through the thus expanded apertures to transfer the image forming material to a recording medium.

In other words, the printing method according to the present invention comprises providing a stencil printing plate comprising a film which is made of a polymeric material that shrinks when it adsorbs a specific compound and in which numerous fine apertures are previously provided in cross sectional direction thereof, obtaining a master by transferring said compound to said film to selectively expand the apertures so that a desired image is reproduced, and transferring an image forming material to a recording medium by passing the image forming material through the expanded apertures of the thus obtained master.

Hence, in accordance with another aspect of the present invention, there is provided a stencil printing plate comprising a film which is made of a polymeric material that shrinks when it adsorbs a specific compound, said film having numerous fine apertures in cross sectional direction thereof.

The stencil printing plate according to the present invention is characterized in that when the film of the plate is brought into contact with a specific compound, preferably a liquid or gaseous one, it adsorbs the compound and shrinks. That is, in response to contact with the aforementioned compound, the surface of the film shrinks and expands the apertures so that an image forming material can easily pass through the apertures. Size of each of the apertures may be such that the image forming material is not easily passed therethrough when the film does not adsorb the compound. More specifically, the size can be properly selected depending on the physical properties, e.g., viscosity, etc., of a printing ink or other image forming materials.

Preferably, the polymeric material constituting the present stencil printing plate is further characterized in that it expands when it adsorbs another compound. In this case, in response to contact with this compound, the surface of the film expands to narrow the apertures, and thereby hinders the passage of the image forming material. Thus, such a polymeric material is advantageous in that the passage of image forming materials can be inhibited irrespective of viscosity and other physical properties of the image forming materials.

Accordingly, the apertures of the plate of the present invention can be reversibly switched from a state in which an ink is allowed to pass to a state in which the passage of the ink is hindered, in response to adsorption or desorption of a specific compound. In other words, the apertures of the plate can be reversibly switched from an opened state to a closed state. Thus, the plate can be regenerated or prepared for re-use in the next printing by closing all of the apertures even after it is once made into a master and used for printing. In order to close the apertures and regenerate the plate, the compound adsorbed by the plate in making a master only has to be desorbed to cancel out the shrinking state, or alternatively, the aforementioned another compound capable of expanding the polymeric material of the film may be brought into contact with either portions in the vicinity of the apertures or the entire surface of the film.

As described above, in the present invention, the plate can be used repeatedly; hence, use of conventional disposable heat-sensitive stencil sheets are not necessary. Thus, all the devices necessary for handling stencil sheets can be eliminated from conventionally used rotary stencil printing machines by applying the present plate to a printing drum of a rotary stencil printing machine with a proper master making function.

In accordance with still another aspect of the present invention, there is provided a stencil printing apparatus comprising an ink-permeable cylindrical printing drum which is rotary driven around its central axis and has the stencil printing plate according to the present invention on an outer circumferential surface thereof, a master making means which transfers said compound to said plate to reproduce a desired image thereon so that said apertures are selectively expanded, a squeegee means disposed to inscribe an inner circumferential surface of said printing drum such that an image forming material supplied to an inside of said printing drum is squeezed outwardly of said printing drum, and a pressing means which applies pressure to at least one of said printing drum and a printing sheet to bring them in close contact with each other while said printing sheet is being moved in synchronism with rotation of said printing drum, so that the image forming material is transferred to the printing sheet from the inside of the printing drum through the expanded apertures of the plate. To further facilitate regeneration of the plate, the stencil printing apparatus may further comprise a means for applying to the plate a compound capable of adsorbing to and expanding the polymeric material of the plate so that the expanded apertures of the plate are narrowed.

BRIEF DESCRIPTION OF THE DRAWINGS

Hereinafter, the present invention will be described in more detail with reference to the appended drawings, in which.

DETAILED DESCRIPTION OF THE PREFERRED EMBODIMENTS

Figure 1:
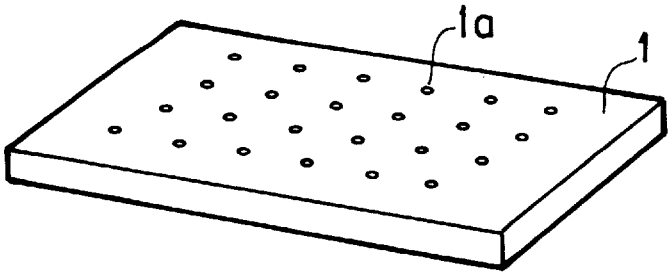
FIG. 1 is a schematically drawn perspective view of a plate for stencil printing according to the present invention, showing the apertures in closed state.

The polymeric materials which constitute the film of the plate according to the present invention include, for instance, polar polymeric materials having a high solubility parameter, and specifically mentioned are polyvinyl pyrrolidone, ethylene-vinyl alcohol copolymers, polyethylene oxide, polyvinyl ether, polydioxolane, polyvinyl acetal, polyvinyl chloride, poylvinylidene chloride, polyvinyl fluoride, polyvinyl acetate, acrylic resin, melamine resin, polyamide, polyimide, polyacrylamide, polyacrylonitrile, polyethyleneimine, polyester, polycarbonate, polyurethane, polysulfone, polysulfoxide, polyphenylene sulfide, polyoxazoline, polyvinyl carbazole, etc. Among them, preferred are polymeric materials which are high in response speed of adsorption and desorption of molecules and also high in expansion coefficient and shrinkage coefficient on adsorbing and desorbing the molecules. If the response speed is low upon adsorbing the molecule, it takes a long time to carry out printing based on a plurality of different image information, and thus efficient printing is not expected. Further, polymeric materials having a low expansion coefficient or shrinkage coefficient is economically disadvantageous, because a large amount of molecules must be adsorbed or desorbed to open or shut the apertures. As favorable polymeric materials satisfying the preferred characteristics above, mentioned are polypyrrole and polythiophene, which can be synthesized by such processes as oxidation polymerization, electrolytic polymerization, and polycondensation. For instance, polypyrrole can be obtained by electrolytic polymerization of pyrrole monomers in an aqueous solution of tetraethylammonium perchlorate. The polymer film made of polypyrrole or polythiophene has a function of reversibly expanding or shrinking as a result of reversible adsorption or desorption of liquid or gaseous molecules of at least one compound selected from water and organic solvents. The above polymeric materials forming a film may be composed of a single kind of polymer component or a blend of two or more components, or a copolymer.

The film for use as the plate of the present invention can be obtained by making the above polymeric material into a film by means of a known method. For example, there can be mentioned a method comprising dissolving a film-forming principal polymer component in a solvent, and applying the thus-obtained solution to a removable support and drying; a method comprising polymerizing monomers on a removable support; or a method comprising forming a polymer film by use of a stretching machine. The thickness of the film is in a range of from 0.5 to 1,000 $\mu$m, and preferably, in a range of from 1 to 500 $\mu$m. A film thinner than 0.5 $\mu$m is inferior in handling properties and strength, and a film thicker than 1,000 $\mu$m not only requires a large amount of liquid or gas to open or shut the apertures, but also may cause difficulty in passing the image forming material.

The fine apertures of the film according to the present invention can be formed by using a perforating device, for example, an excimer laser irradiation device, an electron beam irradiation device, etc., in such a size that the image forming material for use in stencil printing cannot substantially pass through them, and in such a state that they penetrate the film in a cross-sectional direction. When the film is shrinked, i.e., when the apertures are opened, the diameter of the apertures is, in general, in a range of from 0.1 to 500 $\mu$m. If the aperture is less than 0.1 $\mu$m in diameter, the image forming material is difficult to pass through it. If the aperture is more than 500 $\mu$m in diameter, resolution of prints obtained on recording media is low, causing printed images to be unclear.

The plate according to the present invention may be constructed from the aforementioned film alone, but to maintain mechanical strength, the film may be laminated to a porous support. As the porous support, mentioned are tissue paper, non-woven fabrics and screen gauze made from one or a mixture of fibers selected from natural fibers such as Manila hemp, pulp, paper mulberry, paperbush, and Japanese paper; synthetic fibers such as polyester, nylon, vinylon, and acetate; metallic fibers; and glass fibers.

The compound which is to be adsorbed to the film to make the plate into a master according to the present invention, can be properly selected from water and organic solvents, depending on polymeric materials that constitute the film. The organic solvents for use in the present invention are, in general, commonly known organic solvents including those based on aliphatic hydrocarbon, aromatic hydrocarbon, halogenated hydrocarbon, alcohols, ketones, esters, ethers, aldehydes, carboxylic acids, amines, low molecular heterocyclic compounds, and oxides. More specifically, mentioned are hexane, heptane, octane, nitromethane, benzene, toluene, xylene, chloroform, dichloromethane, chlorobenzene, iodomethane, carbon tetrachloride, chlorobenzene, methanol, ethanol, isopropanol, n-propanol, butanol, ethylene glycol, diethylene glycol, propylene glycol, glycerol, acetone, methyl ethyl ketone, ethyl acetate, propyl acetate, ethyl ether, tetrahydrofuran, 1,4-dioxane, lactic acid, propionic acid, formaldehyde, acetoaldehyde, methylamine, ethylenediamine, dimethylformamide, pyridine, and ethylene oxide. Those mentioned above may be used singly or in combination of two or more. If necessary, the solvent may further contain a dye, a pigment, a preservative, a moisturizer, a surfactant, or a pH controller.

Particularly when the film is a polypyrrole film, the apertures are quickly expanded by adsorption of water. Thus, the polypyrrole film is advantageous because the master can be made by transfer of water molecules to the film.

The plate according to the present invention can be made into a printing master by adsorbing and transferring a above-mentioned compound to the film. The compound is preferably transferred in a form of liquid or gas. When the plate once made into a master is regenerated, the compound adsorbed to the film may be desorbed by allowing it to evaporate naturally, or another compound which expands the film may be newly adsorbed by the film. For instance, since a polypyrrole film expands itself and thereby narrows the apertures by adsorbing a polar organic solvent such as alcohol, aldehyde, monohaloalkane, or iodomethane, the film can be regenerated by applying these organic solvents thereto. Among them, iodomethane is particularly preferred because it adsorbs to the film by substituting waterequiecules that have adsorbed to the film with equilibrium state.

In order to make a master from the plate according to the present invention, an above-mentioned compound for making a master is transferred to the film in such a manner that a desired image is thereby reproduced, and, for example, the above compound can be applied in a form of liquid by use of a writing means such as a pen, a brush, etc., or applied in a non-contact state by use of a device, for example, a liquid ejecting device equipped with a heat generating element or a piezoelectric element, or a spray, a mist generating device, or an evaporated-gas generating device.

In the present invention, printing can be performed in accordance with a general method of stencil printing after the plate is processed into a master in the manner described above. For instance, an image forming material such as an ink is placed on one side of the master while superposing a recording medium such as a printing sheet on the other side, and then a pressure is applied by an aid of a pressing mechanism such as a press, a decompression device or a squeegee so as to allow the ink to pass through the expanded apertures of the plate and transfer to the recording medium.

The image forming material includes a liquid printing ink, a solid powder, and an image forming precursor. As the liquid ink, mention may be made of an oil ink, an aqueous ink, a water-in-oil (w/o) emulsion ink, an oil-in-water (o/w) emulsion ink, and a hot-melt ink. As the solid powder, mention may be made of a toner used in electrophotographic copiers, and a magnetic powder. As the image forming precursors, mention may be made of a reactive dye and a chelate color former.

The recording media include printing paper, plastic sheets, plates made of wood, metal or the like, and an article containing a compound to be reacted with the aforementioned image forming precursor.

EXAMPLE

The present invention is described in further detail below by way of a specific example referring to the drawings, but it should be understood that the present invention is by no means limited thereto.

FIG. 1 is a schematically drawn perspective view of a stencil printing plate according to the present invention, showing the apertures in closed state. In FIG. 1, a plate denoted by the numeral 1 is composed of a single film made of a polymeric material which shrinks by adsorption of a specific compound, and numerous fine apertures 1*a* are uniformly formed in the cross sectional direction. In this state, the opening of the apertures 1*a* has a size that is small sufficiently to prevent passage of image forming materials.

Figure 2:
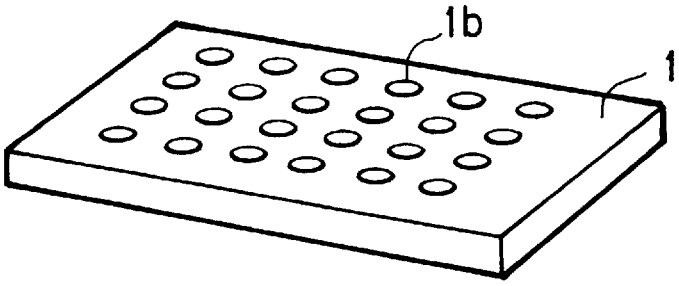
FIG. 2 is a schematically drawn perspective view of a plate for stencil printing according to the present invention, showing the apertures in opened state.

FIG. 2 is a schematically drawn perspective view which shows that the plate 1 of FIG. 1 is coated with and adsorbs a compound which shrinks the polymeric material above. In this state, the apertures 1*b* are opened because the surface of the film around the apertures 1*b* shrinks, and the image forming material is allowed to pass through the apertures 1*b*. Thus, by placing an image forming material on one side of the plate 1 while bringing a recording medium in contact with the other side and pressing the image forming material against the recording medium, the image forming material is transferred to the recording medium through the apertures 1*b*. It can be seen clearly from the above that, by selectively opening and closing the apertures in accordance with a desired image, the present plate can be used in place of stencil sheets that have conventionally been used in various types of stencil printing apparatus. The plate 1 is preferably extended on a frame and fixed thereto on each side thereof, or fixed on a printing drum of a rotary stencil printing apparatus by use of a proper fixing means, so that the profile dimension of the plate does not change by shrinkage and expansion of the polymeric material.

When the previously coated and adsorbed compound is desorbed from the plate 1 of FIG. 2 by means of evaporation or the like, the plate 1 recovers the state shown in FIG. 1, and the plate 1 is regenerated to inhibit the passage of the image forming material through the apertures 1*a*. Since the plate 1 can reversibly repeat shrinking and recovery in the above-mentioned manner, the apertures can be reversibly opened and closed. Thus, the plate 1 can be used in master making and printing repeatedly.

Figure 3:
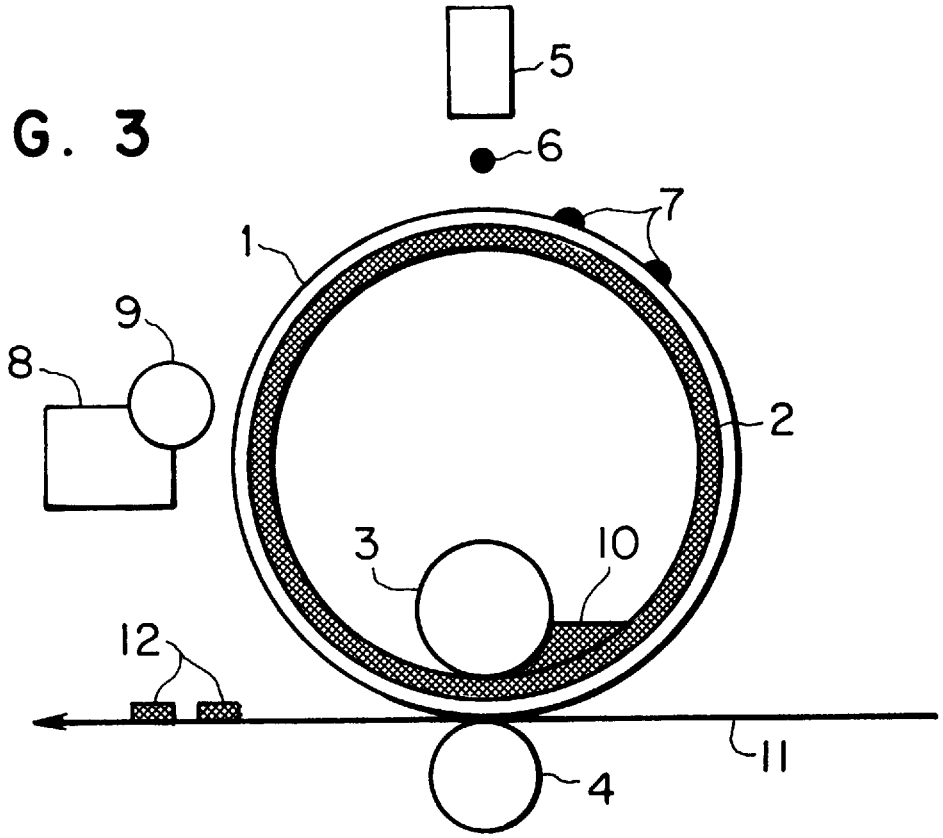
FIG. 3 is a schematically drawn cross-sectional view showing an embodiment of a stencil printing apparatus equipped with a printing drum having a plate for stencil printing according to the present invention.

FIG. 3 is a schematically drawn cross-sectional view showing an embodiment of a rotary stencil printing apparatus which practices the present printing method. The printing apparatus of FIG. 3 comprises a cylindrical printing drum 2 which is rotary driven about a central axis of the drum. The printing drum 2 comprises such an ink-permeable cylindrical porous member as used in conventional printing apparatus, and comprises the plate 1 shown FIGS. 1 and 2 which is layered on an outer circumferential surface of the cylindrical porous member. Further, a squeegee roller 3 is disposed inside the printing drum 2 to inscribe an inner circumferential surface of the cylindrical porous member, and is rotary driven in the same direction as the printing drum 2 when printing is carried out.

Further, the apparatus of FIG. 3 is equipped with an ink-jet type liquid ejecting means 5 disposed adjacent to the printing drum 2. The liquid ejecting means 5 is provided to eject, to the surface of the plate 1, a liquid compound 6 capable of shrinking the polymeric material of the plate 1 in accordance with image information that has previously been converted into an electric signal, whereby the image is reproduced on the plate 1. The apparatus shown in FIG. 3 is equipped with a liquid coating means 8 disposed adjacent to the printing drum 2. The liquid coating means 8 is equipped with a coating roller 9, so that a liquid compound capable of expanding the polymeric material of the plate 1 may be applied to the entire surface of the plate 1.

Printing can be performed in the apparatus of FIG. 3 as follows. First, while the printing drum 2 is properly rotated, a liquid compound 6 is ejected from the liquid ejecting means 5 so that the compound 6 is transferred to the plate 1 to reproduce a desired image thereon. Then, a master is produced because portions of the plate 1 to which the liquid compound 6 has been transferred and has adsorbed shrink, and the apertures in the vicinity of the above portions open to allow a printing ink 10 supplied to the inside of the printing drum 2 to pass through the apertures. When a printing sheet 11 is pressed by a press roller 4 against the plate 1 while being conveyed in synchronism with rotation of the printing drum 2, the printing ink 10 is pressed to the outside of the printing drum 2 by a squeegee roller 3, and at the same time, is transferred to the printing sheet 11 through the opened apertures of the plate 1. Thus, a printing image 12 is obtained on the printing sheet 11.

When another printing is performed in accordance with different image information in the apparatus shown in FIG. 3, a liquid compound capable of expanding the polymeric material of the plate 1 is coated on the surface of the plate 1 by use of the coating roller 9 of a liquid coating means 8. Then, the compound newly applied by the coating roller 9 is adsorbed by the plate 1 while the liquid 7 previously transferred to the plate 1 is desorbed from the plate 1, and as a result, the apertures is closed to regenerate the plate 1. Then, by transferring the liquid compound 6 from the liquid ejecting means 5 to the surface of the plate 1 in accordance with the different image information to reproduce the image thereon, apertures open in accordance with the image. Accordingly, this different image can be printed by conveying a printing sheet 11 in synchronism with the rotation of the printing drum 2 while the sheet 11 is pressed against the plate 1 by the press roller 4.

In the structure shown in FIG. 3, a polypyrrole film was used as the plate 1, water was used as the liquid compound 6, and iodomethane was used as the liquid which was to be applied by the liquid coating means 8. Then, as in the same procedure as described above, the plate 1 was made into a master by ejecting water from the liquid ejecting means 5, and then printing was carried out. As a result, a desired image was printed on the printing sheet 11. After the printing, iodomethane was applied to the surface of the plate 1 by the liquid coating means 8, and printing operation was conducted in the same manner as above. Then, regeneration of the plate 1 was confirmed because no image was printed on the printing sheet 11. Furthermore, a master was again made from the plate 1 as described above, and printing was performed in the same manner as above. Then, the desired printing image was printed on a printing sheet 11.

According to the present invention, a regenerable stencil printing plate is provided, which can be repeatedly used in master making and printing. Thus, the stencil printing apparatus can abolish use of stencil sheets, and can eliminate such members as conventionally required for storing, conveying, and disposing stencil sheets. Accordingly, the present invention makes it possible to render a printing apparatus small-sized and contributes to reduction of wastes.

Although the present invention has been described in terms of a specific embodiment thereof, it is possible to modify and alter details thereof without departing from the spirit and scopes of the present invention.

What is claimed is:

1. A stencil printing method which comprises providing a film made of a polymeric material that shrinks when it adsorbs a specific compound, said film having numerous fine apertures in cross sectional direction thereof, transferring said compound to said film in such a manner that a desired image is reproduced to expand said apertures selectively at sites to which the compound is transferred, and allowing an image forming material to pass through the thus expanded apertures and transfer to a recording medium.

2. A stencil printing method according to claim 1, in which said polymeric material is mainly composed of polypyrrole or polythiophene.

3. A stencil printing plate comprising a film which is made of a polymeric material that shrinks when it adsorbs a specific compound, said film having numerous fine apertures in cross sectional direction thereof.

4. A stencil printing plate according to claim 3, in which said polymeric material is mainly composed of polypyrrole or polythiophene.

5. A stencil printing apparatus comprising an ink-permeable cylindrical printing drum which is rotary driven around its central axis and has a stencil printing plate on an outer circumferential surface thereof, said stencil printing plate comprising a film which is made of a polymeric material that shrinks when it adsorbs a specific compound, and said film having numerous fine apertures in cross sectional direction thereof, a master making means which transfers said compound to said plate to reproduce a desired image thereon so that said apertures are selectively expanded, a squeegee means disposed to inscribe an inner circumferential surface of said printing drum such that an image forming material supplied to an inside of said printing drum is squeezed outwardly of said printing drum, and a pressing means which applies pressure to at least one of said printing drum and a printing sheet to bring them in close contact with each other while said printing sheet is being moved in synchronism with rotation of said printing drum, so that the image forming material is transferred to the printing sheet from the inside of the printing drum through the expanded apertures of the plate.

6. A stencil printing apparatus defined in claim 5, in which the apparatus further comprises a means for coating a compound capable of adsorbing to the plate and expanding said polymeric material to narrow the expanded apertures of said plate.

7. A stencil printing apparatus defined in claim 5, in which said plate comprises a film made of a polymeric material mainly composed of one selected from polypyrrole and polythiophene.

* * * * *